US005081928A

United States Patent [19]

Harrison

[11] Patent Number: 5,081,928

[45] Date of Patent: Jan. 21, 1992

[54] MULTIPLE INK ROLL SYSTEM FOR FLEXOGRAPHIC PRINTING STATIONS

[75] Inventor: John R. Harrison, Baltimore, Md.

[73] Assignee: Ward Holding Company, Inc., Wilmington, Del.

[21] Appl. No.: 556,887

[22] Filed: Jul. 23, 1990

[51] Int. Cl.[5] ..... B41F 31/04; B41F 31/08

[52] U.S. Cl. ..... 101/351; 101/366

[58] Field of Search ..... 101/350, 351, 352, 363, 101/364, 207, 208-210, 148, 366, 157, 169; 118/261, 259, 263

[56] References Cited

U.S. PATENT DOCUMENTS

| | | | |
|---|---|---|---|
| 1,024,473 | 4/1912 | Firm . | |
| 1,911,048 | 5/1933 | Adgit et al. . | |
| 1,980,639 | 11/1934 | Schlesinger . | |
| 3,306,197 | 2/1967 | Jensen et al. . | |
| 3,630,146 | 12/1971 | Shields | 101/351 |
| 3,734,014 | 5/1973 | Oda . | |
| 3,793,952 | 2/1974 | Neumann et al. | 101/157 |
| 4,150,621 | 4/1979 | Raible | 101/350 |
| 4,370,926 | 2/1983 | Hattori | 101/183 |
| 4,397,237 | 8/1983 | Makosch . | |
| 4,528,907 | 7/1985 | Davison | 101/352 |
| 4,744,297 | 5/1988 | Sardella et al. . | |
| 5,003,876 | 4/1991 | Harrison et al. | 101/350 |

FOREIGN PATENT DOCUMENTS

| | | | |
|---|---|---|---|
| 1937986 | 2/1970 | Fed. Rep. of Germany | 101/366 |

*Primary Examiner*—J. Reed Fisher

*Attorney, Agent, or Firm*—Boyce C. Dent; Edward D. Bartlett

[57] ABSTRACT

A printing apparatus has a printing cylinder rotatably supported by a main frame. A subassembly contains a plurality of anilox rolls rotatable about parallel spaced-apart axis with the subassembly being rotatable about an axis parallel to and between these spaced-apart axes. A locking arrangement secures the subassembly in selected positions whereby any selected one of the anilox rolls can be brought into an operative position for cooperating with the printing cylinder for printing. Alternative ink systems supply ink to the selected anilox roll when in the operative position. Preferably the subassembly is supported at its ends by gear casings which are adjustably rotatably mounted in a subframe which itself is pivotally mounted in the main frame. The ink rolls may be anilox rolls with different surface screens.

28 Claims, 6 Drawing Sheets

MULTIPLE INK ROLL SYSTEM FOR FLEXOGRAPHIC PRINTING STATIONS

FIELD OF THE INVENTION

This invention relates to printing, particularly flexographic printing, and is concerned with providing a novel multiple ink roll system for the or each printing station. The invention is particularly concerned with providing alternative anilox rolls at a single flexographic printing station.

BACKGROUND OF THE INVENTION

A conventional flexographic printing station has a printing cylinder (also called a die cylinder) and an impression cylinder between which sheets, for example corrugated paper board blanks, are sequentially advanced for flexographic printing thereon. A printing die is mounted on the printing cylinder, for example by vacuum as disclosed in U.S. Pat. No. 4,744,297. Ink is applied to the printing die by an ink applicator roll (often referred to as an anilox roll) which has an engraved surface providing ink cells for holding ink to be transferred to the printing die. The ink may be uniformly squeegeed into the cells of the anilox roll by a rubber (or plastic) covered wipe roll rotating in tangential contact with the anilox roll. The ink is supplied to the top in-going nip of these rolls from an ink supply pipe so that a bead or reservoir of ink is formed in the nip. Excess ink runs off the ends of the rolls and falls into an ink pan below from which it flows through a drain back to the ink supply system.

Both the anilox and wipe rolls are conventionally mounted on inner frames pivotally movable with respect to a main frame of the printing station. Air cylinders can be used to pivot the anilox roll into and out of engagement with the printing cylinder. When blanks are not being advanced, the inner frames are pivoted away from the printing cylinder to stop the transfer of ink to the printing die, so avoiding build up Of ink on the die while the printing cylinder continues to rotate or is slowing to a halt, as well understood by those skilled in the art. When pivoted away from the printing cylinder, a main clutch in the drive train from the printing cylinder to the anilox roll is disengaged so that the printing cylinder does not drive the anilox roll.

The wipe roll can be driven by a wipe roll drive motor at a constant speed slower than the speed of the anilox roll when the anilox roll is rotated at maximum machine speed, for example the speed ratio between the anilox roll and the wipe roll may be approximately 8:1. This provides a wiping action between the surfaces of the rolls to squeegee the ink into the ink cells of the anilox roll. If a main machine containing the printing station is run at less than maximum speed, this ratio between the rolls decreases proportionately. When the machine is stopped, the wipe roll may continue to run at constant speed with friction between the roll surfaces also causing the anilox roll to turn at wipe rolls speed, the main drive clutch having been disengaged. Running the rolls at idle speed keeps water-based flexographic ink from drying on the roll surfaces.

The wipe roll can also be pivotally mounted and held against the anilox roll during operation. When the anilox roll is pivoted away from the printing cylinder, contact can be maintained between these rolls so that the bead or reservoir of ink does not fall through the nip. However, when the system is to be cleaned prior to changing ink colors, air cylinders are actuated to move the wipe roll away from the anilox roll to dump the ink into the ink pan for draining back to the ink supply system.

Anilox rolls with different surface screens are available, e.g. surfaces formed with small pyramids, or quadrangles, or hexagon shapes, or having channels therein etc. These differently engraved anilox rolls can provide different printing qualities. When installing a new printing station, the anilox roll may be chosen which best suits the majority of the printing intended to be performed at that printing station.

SUMMARY OF THE INVENTION

An object of the present invention is to provide a plurality of ink rolls, particularly anilox rolls, for a single printing cylinder at a printing station with one ink roll at a time being selectable for use. This has the advantage of improved versatility of printing by being able to have ink rolls of different specifications readily available for selection, and it also has the additional or alternative advantage of having one or more back-up ink rolls readily available should the ink roll in use become defective.

A feature by which this is achieved is to mount a plurality of ink rolls in a movable subframe adjacent the printing cylinder, preferably for example by mounting three anilox rolls in a rotatable subassembly below the printing cylinder.

Accordingly, therefore, there is provided by one aspect of the present invention a printing apparatus comprising a printing cylinder rotatably mounted in a main frame, a plurality of ink rolls mounted for rotation about parallel spaced-apart axes in a subassembly, the subassembly being movable relative to the main frame to bring any selected one of the ink rolls into a cooperative position relative to the printing cylinder for printing, and an inking system for inking only the selected ink roll in the cooperative position.

The ink rolls may be anilox rolls with different surface screens.

The inking system may comprise two alternatively operable ink systems, preferably a wipe roll on one side of the selected ink roll and a doctor blade assembly on the other side of the selected ink roll. Such wipe roll and doctor blade assembly may conveniently be movable to totally inoperative positions to make room for movement of the ink roll subassembly when selecting one of the ink rolls and locating it in the cooperative position.

The ink roll subassembly may be rotatable for ink roll selection.

Preferably, the ink roll subassembly comprises two, three or more ink rolls all rotatable about parallel spaced-apart axes with the ink roll subassembly being rotatable about an axis parallel to and between these spaced-apart axes.

The ink roll subassembly may be mounted between rotatable gear casings containing gears for drivingly rotating at least the selected ink roll.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters in the same or different Figures indicate like parts.

DETAILED DESCRIPTION OF THE PREFERRED EMBODIMENT

The preferred embodiment of a single printing station employing the present invention is shown in FIGS. 1 through 7. This preferred printing station may be a printing section in a flexographic printing machine. This may be the only printing station in the machine, or the machine may have a number of such stations sequentially one after the other. This printing station, or stations, may conveniently be incorporated in a sheet processing machine for performing additional operations such as, for example, slotting, creasing, die cutting, etc.

Figure 1:
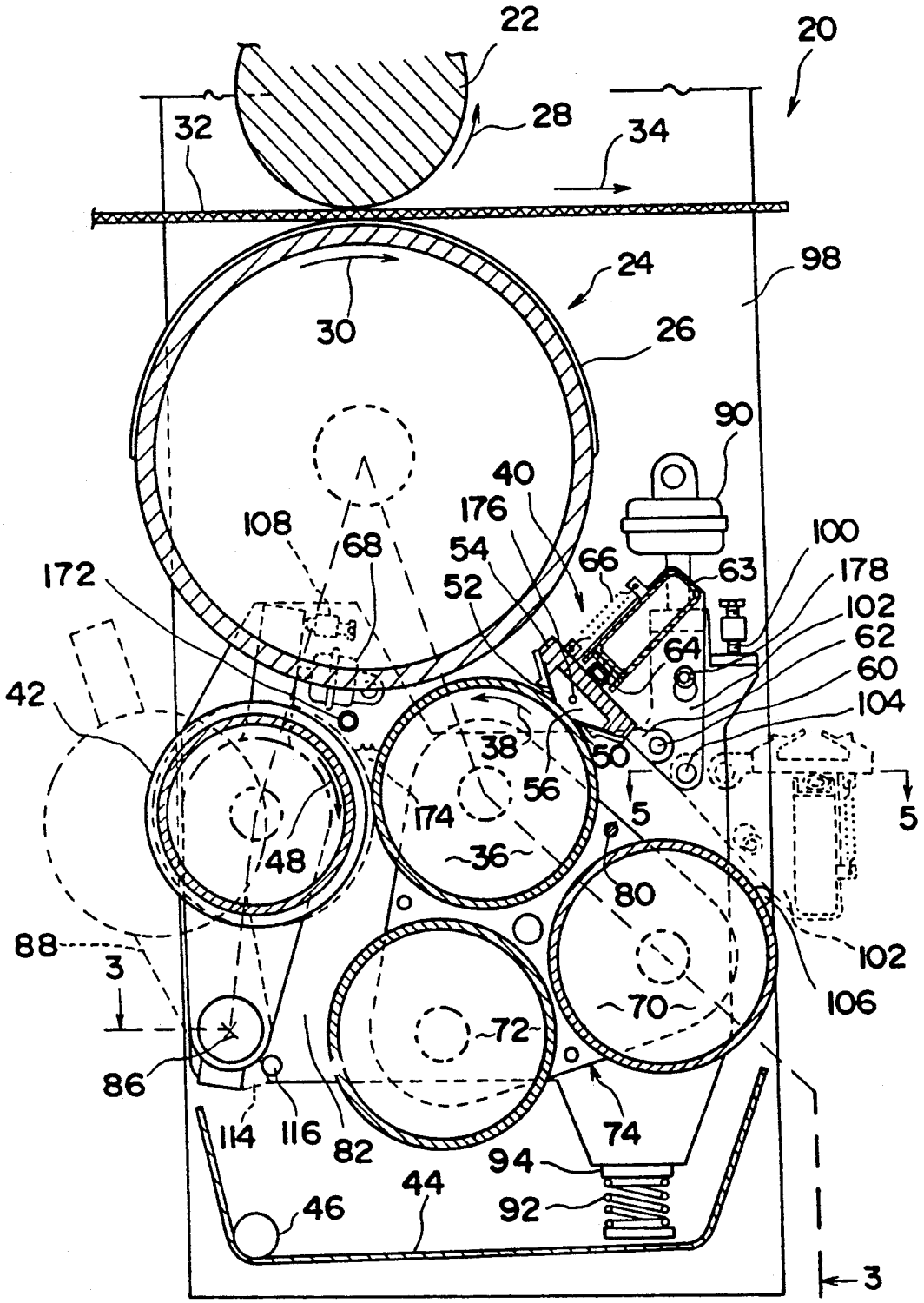
FIG. 1 is a vertical section in side view illustrating the main portion of a flexographic printing station taken in the plane 1—1 of FIG. 3 and showing three ink applicator rolls individually selectable to operate in conjunction with a wipe roll or a doctor blade assembly.

FIG. 1 is a vertical section through the printing station and shows the preferred arrangement of the main operating elements for versatile printing. At the top is an impression cylinder 22 which cooperates with a printing cylinder 24 having mounted thereon a printing die 26. The cylinders 22 and 24 rotate respectively in the direction of the arrows 28 and 30 to feed a sheet 32 therebetween in the direction of the arrow 34 with the sheet 32 being printed on the underside thereof. An upper anilox roll 36 is rotated counterclockwise in the direction of the arrow 38 and inks the printing die 26. Ink is supplied to the surface of the anilox roll 36 either via a double doctor blade assembly 40 or a wipe roll 42, in FIG. 1 the doctor blade assembly 40 being shown in operative engagement with the anilox roll 36 and the wipe roll 42 being disengaged in a non-working position. Excess ink from either the doctor blade inking system or the wipe roll inking system flows down and is collected in an ink tray 44 from which it is removed from a drain 46. The wipe roll 42, when operative, is rotated clockwise in the direction of the arrow 48. The general construction and operation of the double doctor blade head assembly 40, the functioning of the alternative doctor blade inking system and wipe roll inking system, the manner of circulating the ink, and a manner of washing the system is described in detail in copending U.S. Pat. application No. 310,065 (now U.S. Pat. No. 5,003,876) the disclosure of which is hereby incorporated herein by reference.

The dual doctor blade system is used to ink the anilox roll for half-tone printing dies (e.g. when printing with one color) or process printing (e.g. half-tone, multiple-colors using two or more adjacent printing sections). The wipe roll 42 is used when printing large non-half-tone printed areas requiring a heavier application of ink to the printing die. Briefly, the dual doctor blade system includes two opposed doctor blades 50, 52 mounted to a channel support 54 to form a closed ink supply chamber 56 in conjunction with the surface of the anilox roll 36, as shown in FIG. 1. The channel 54 is pivotal about pivot 60 on pivotal support plates 62. A support beam 63 is fixed between the support plates 62. An expandable air hose 64, between the beam 63 and channel 54, urges the doctor blades 50, 52 into tight controlled contact against the anilox roll surface. A spring 66 attached between the beam 63 and channel 54 pulls the channel and blades away from the anilox roll 36 when air pressure is not supplied to the air hose 64. When printing with the wipe roll 42, no air is supplied to the air hose 64 and no ink is supplied to the chamber 56. When printing with the doctor blade ink supply system, a short stroke air cylinder 68 pivots the wipe roll 42 out of contact with the anilox roll 36.

It should be particularly noted that two additional anilox rolls 70, 72 are provided with means for selectively operating any one of the three anilox rolls 36, 70, 72 in conjunction with either the wipe 42 roll or the dual doctor blade assembly 40. In addition, means are provided for easily removing and replacing any one of the three anilox roll and the wipe roll. In FIG. 1, the anilox roll 36 is in the operative position while the other anilox rolls 70, 72 are in inoperative, standby positions.

Figure 2:
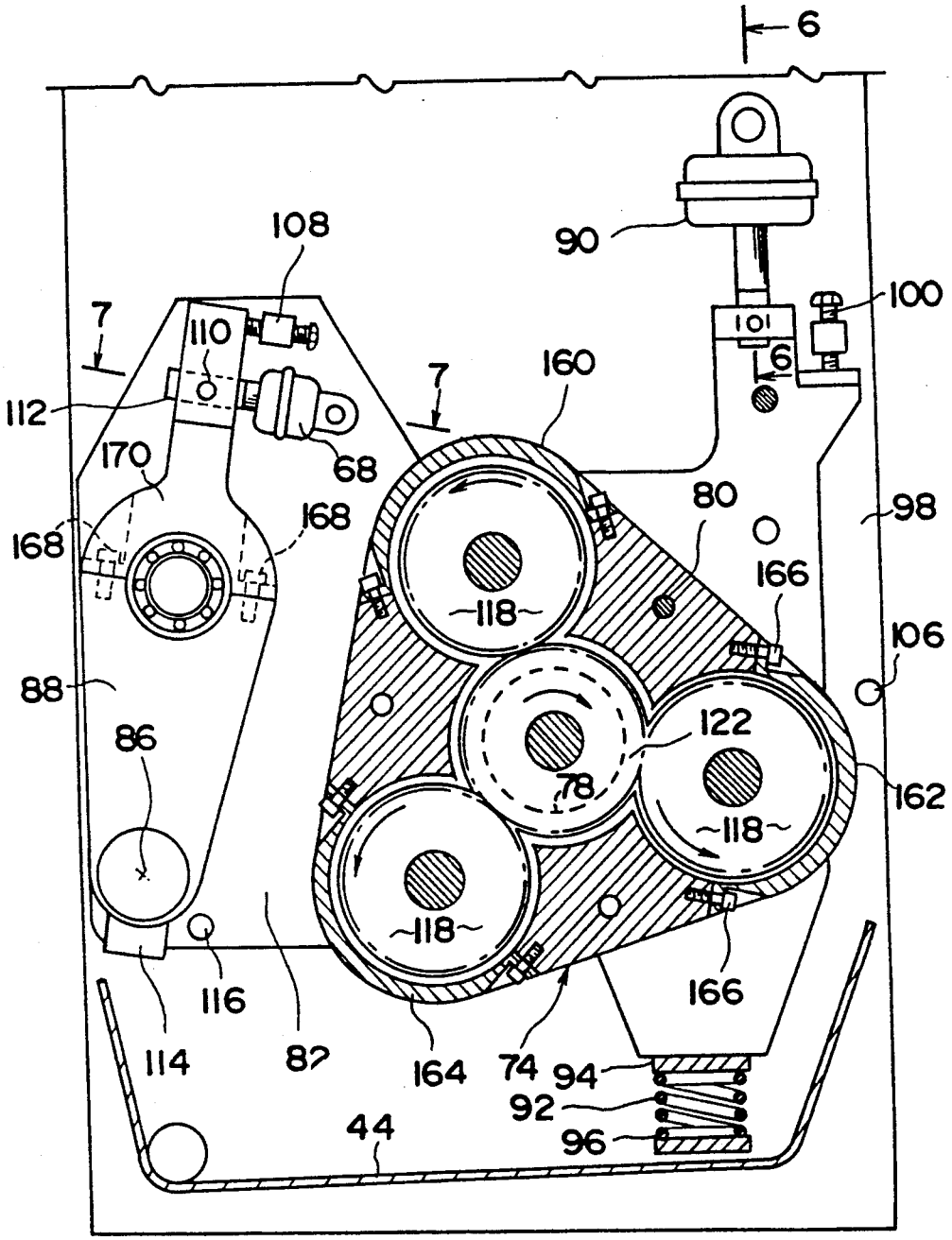
FIG. 2 is a vertical section, similar to FIG. 1, taken in the plane of 2—2 of FIG. 3 and showing a gear arrangement for driving the three ink rolls, means for removably mounting the ink rolls, the mounting arrangement for the wipe roll, and the arrangement for pivoting the operative ink roll out of engagement with the printing cylinder.
Figure 3:
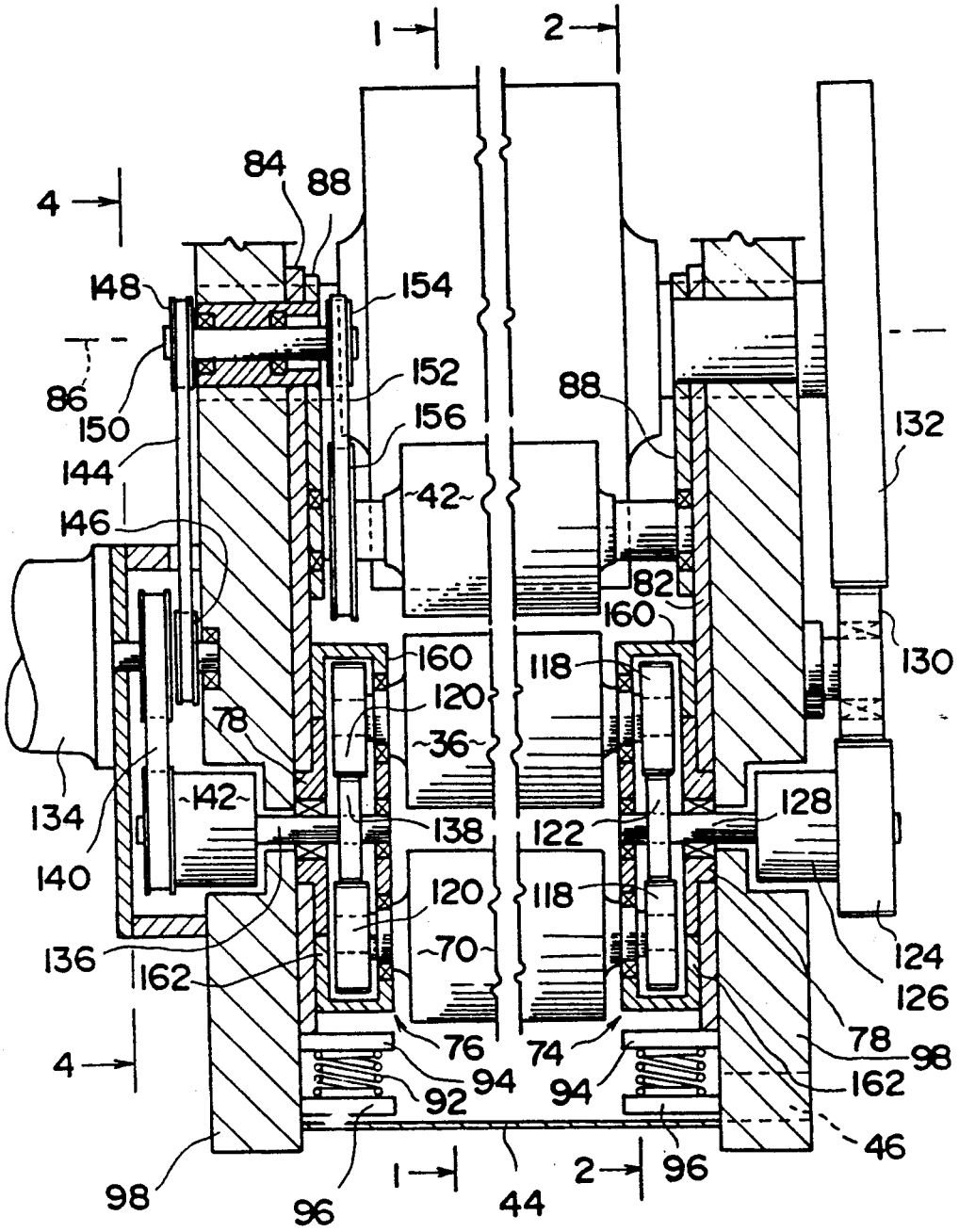
FIG. 3 is a sectional view of the printing station of FIG. 1 developed along the angled line 3—3 of FIG. 1.

With reference now generally to FIGS. 1, 2 and 3, the three anilox rolls 36, 70, 72 are each rotatably mounted in and between two triangular gear cases 74, 76. The gear cases 74, 76 are rotatably mounted on trunnions 78 to place any one of the three anilox rolls in the upper position for contact with the printing die 26 on the printing cylinder 24. A locking pin 80 holds each gear case in the selected rotational position. Inner side frames 82, 84 are pivotal about an axis 86, which is also the pivotal axis for support arms 88 of the wipe roll 12. A short stroke air cylinder 90 (upper right in FIGS. 1 and 2) pivots the inner frames 82, 84, and therefore the upper anilox roll 36, toward and away from the printing cylinder 26. Since the three anilox roll subassembly is much heavier than a conventional single, anilox roll assembly, counter balancing springs 92 are used to support the assembly so that less force need be exerted by the short stroke air cylinder 90. This enables the air cylinders to be smaller. These compression springs 92 are contained between an extension plate 94 on each inner side frame 82, 84 and a similar plate 96 fastened to the main frame 98 of this printing section 20 of the machine. It will be noted that the springs 92 are located inside the ink pan 44. An adjustable inner-side frame stop 100, comprising a block secured to the main frame and adjustment screw, controls how tightly the selected anilox roll contacts the printing die during printing. The end of the extension stroke of the air cylinder 90 controls how far the inner side frames 82, 84 are pivoted downward (i.e. clockwise in FIGS. 1 and 2 about axis 86). Similar stops 100 on both frames permit the anilox roll to be paralleled to the printing cylinder 24. The stops 100 control how far the inner side frames 82, 84 pivot upwards. In addition, should one anilox roll be smaller or larger than the others (for example, due to manufacturing tolerances), these stops can be used to again adjust the pressure of the selected anilox roll against the printing die. This is advantageous when an anilox roll is replaced since a re-engraved diameter may be different from the original.

Figure 5:
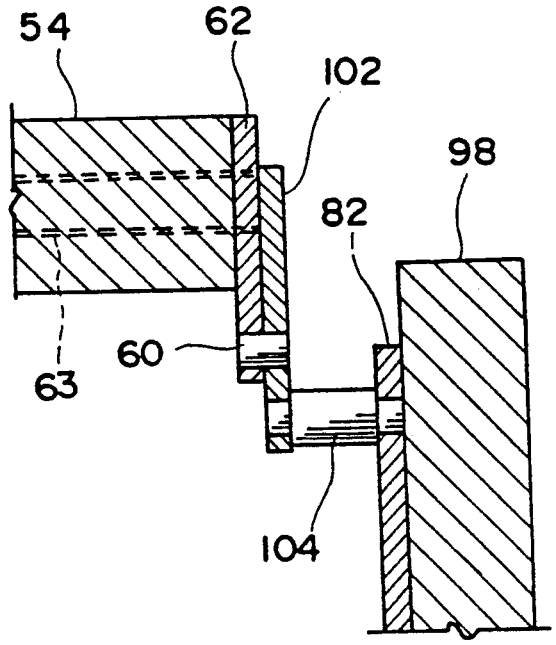
FIG. 5 is a sectional view taken along the line 5—5 of FIG. 1 and showing the pivotal mounting of the doctor blade assembly.
Figure 6:
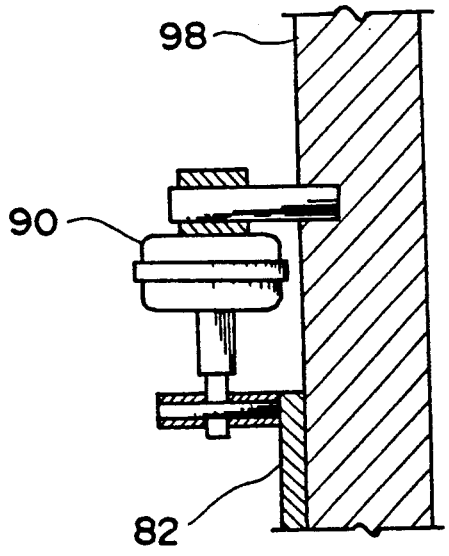
FIG. 6 is a sectional view taken along the line 6—6 of FIG. 2 and showing the pivotal actuating means for bringing the operative ink roll out of engagement with the printing cylinder.
Figure 7:
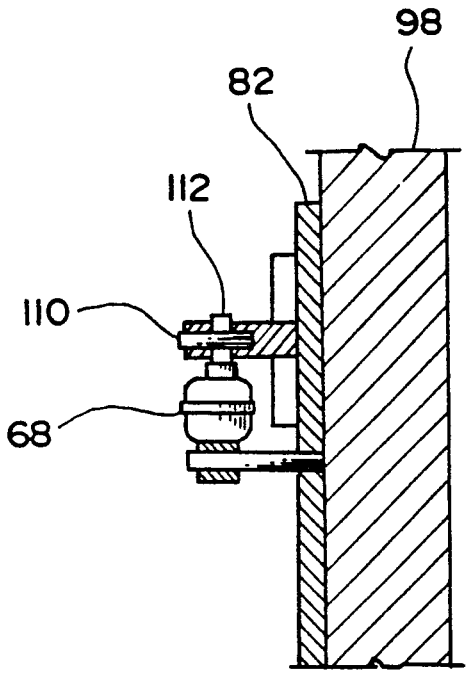
FIG. 7 is a sectional view taken along the line 7—7 of FIG. 2 and showing the pivotal actuating means for bringing the wipe roll in and out of engagement with the operative ink roll.

The entire dual doctor blade assembly 40 is mounted to triangular support plates 102 which are pivotally mounted to the inner frames on pivots 104 (see also FIG. 5). Thus, when the inner side frames 82 84 are pivoted away from the printing cylinder 24, the contact between the doctor blades 50, 52 and anilox roll 86 is not changed and this keeps the ink contained in the ink chamber 56. The channel support 54 is pivotal about pivots 60 while the support beam 63 is fixed to the triangular support plates 102. The air tube 64 controls the pressure of the blades 50, 52 against the selected anilox roll. A locking ring keeps the triangular plates 102 in position on the inner frames 82, 84.

The entire doctor blade assembly 40 is pivotal about the pivots 104 to the pivoted out position shown by the dotted lines in FIG. 1 where the assembly 40 is stopped by and rests against a pin stop 106 on the main frame 98. Firstly, this pivoted out, totally inoperative position, away from the anilox roll subassembly, provides clearance for rotation of the gear cases 74, 76 about the trunnions 78 to place any selected one of the other anilox rolls 70, 72 in the operative printing position. Secondly, it places the doctor blade assembly in an accessible position for thorough manual cleaning and for changing the doctor blades.

The rubber covered wipe roll 42 is bearing mounted for rotation in the pair of wipe roll support arms 88 pivotally mounted about axis 86. The air cylinders 68, one on each side, push the wipe roll 42 out of contact with the upper selected anilox roll when the doctor blade ink supply is being used, and conversely pull the wipe roll 42 into contact with the selected anilox roll when the wipe roll ink supply is being used. An adjustable stop 108 in each inner side frame controls the contact pressure between the wipe roll 42 and the operative anilox roll. The stops 108 can be used, as with the stops 100 for the inner side frames 82, ~~84~~ to adjust the rolls for parallelism and different sizes. Since these air cylinders and stops are mounted on the inner side frames 82, 84, pivoting these inner frames does not alter the relative position of the wipe roll 42 with respect to the operative anilox roll in any position.

The wipe roll 42 is moved into the totally inoperative position shown by the dotted lines in FIG. 1 to provide clearance for rotation of the subassembly of the three anilox rolls to bring another anilox roll into printing position. This is done by removing a connecting pin 110 (see FIGS. 2 and 7) to disengage the actuating rod 112 of the wipe roll air cylinder 68 from each wipe roll support arm 88, and manually moving the wipe roll 42 away from the anilox rolls assembly until a lug 114 on each support arm 88 engage a stop pin 116 on the inner frames as shown in broken lines in FIG. 1. This also places the wipe roll 42 in position for complete removal as will be later explained.

Figure 4:
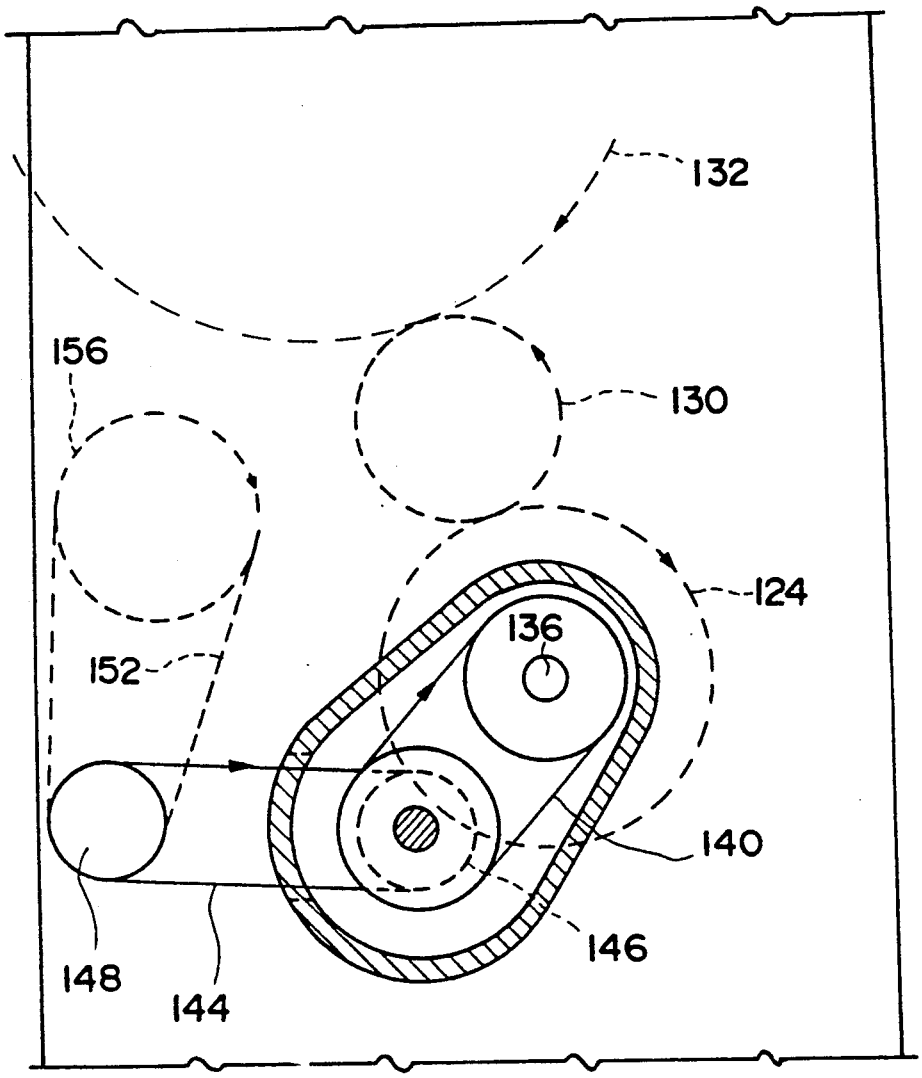
FIG. 4 is a side elevation, partly in section, taken generally in the plane of the line 4—4 of FIG. 3 and illustrating the drive arrangement for the three ink rolls, the drive arrangement for the wipe roll, and also the drive arrangement for "idling" the three ink rolls and the wipe rolls.

Referring now to FIG. 2, 3, and 4, the anilox roll drive construction is as follows. Both ends of each of the three anilox rolls 36, 70, 72 include a spur gear, a gear 118 on the right end in FIG. 3 and a gear 120 of the left end. The gears on the right (in FIG. 3) mesh with a central drive gear 122 mounted centrally in the triangular gear case 74. This central drive gear 122 is driven by an anilox roll drive gear 124, located outside the main frame 98, through an electric clutch 126 on a main input drive shaft 128 The anilox roll drive gear 124 is driven through an idler gear 130 by a printing cylinder drive gear 132 which in turn is driven by a main machine drive motor via a machine gear train—not shown. The anilox rolls 36, 70, 72 are rotatably driven by the foregoing gears when the top anilox roll is in the printing position, that is in the position to apply ink to the printing die.

When the inner side frames 82, 84 are pivoted to bring the top anilox roll out of engagement with the printing cylinder 24, this anilox roll should still be driven at low speed to keep the ink from drying on it. When the doctor blade system is being used, the anilox rolls are driven by the wipe roll drive motor 134 (outside the left main frame in FIG. 3). An auxiliary input drive shaft 136 is connected to an auxiliary central drive gear 138 at the left in FIG. 3 and coaxial with the right central gear 122. The auxiliary gear 38 is driven by the motor 134 through a timing belt 140 surrounding timing belt pulleys on the output shaft of the motor 134 and on an electric clutch 142 on the auxiliary input drive shaft 136. When the wipe roll 42 is being used, friction between the wipe roll and engaged anilox roll turns the anilox roll, the wipe roll being driven by the wipe roll drive motor 134. In this situation, the auxiliary electric clutch 142 is de-energized.

The wipe roll 42 is driven by a timing belt 144 surrounding a timing belt pulley 146, outside the main left frame 98, on the output shaft of the wipe roll motor 134 and a timing belt pulley 148 on a spindle 150 that also serves as a pivot pin on axis 86 for both the inner side frame 88 and the adjacent wipe roll support arm 88. Power is transferred to inside the left main frame 98 by the spindle 150 which is bearing mounted in the frame 98. Another timing belt 152 surrounds a pulley 154 on an inner end of the spindle 150 and a pulley 156 on the left end of the wipe roll 42. Since the wipe roll, when used, is always rotated at a constant speed regardless of machine speed, the wipe roll need not be driven on the right side (in FIG. 3) as are the three anilox rolls 36, 70, 72.

The triangular gear cases 74, 76 for the three anilox rolls are made with removable bearing caps 160, 162, 164 as shown in FIGS. 2 and 3. The inside flanges of the bearing caps fit around the bearings of the anilox rolls 36, 70, 72; the outside flanges merely meet the main body of the respective gear case. The anilox roll to be removed is placed in the position of roll 70 in FIG. 1. Mounting bolts 166 (FIG. 2) are removed to free the bearing caps at each end and then the roll can be lifted out of the gear cases, the end gears 118, 120 disengaging and merely coming out of mesh.

The wipe roll 42 may be removed by first pivoting the support arms 88 to the dotted line position shown in FIG. 1 as previously explained The belt 152 on the inside of the drive spindle 150 is pulled off pulley 154.

This particular pulley 154 is flangeless to permit this, the larger pulley 156 on the end of the wipe roll 42 includes flanges for guiding the belt 152. Thus, the belt 152 will hang loose on the large pulley 156. Bolts 168 (FIG. 2) on the bearing caps 170 at each end are then removed and the bearing caps 170 removed Then the wipe roll can be lifted out of the bearing sockets in the support arms 88.

To operate the printing station using the wipe roll inking system, the short stroke air cylinder 68 is energized to bring the wipe roll 42 into contact with the anilox roll being used, i.e. the uppermost anilox roll. The ink system (not shown) is turned on to supply ink through an ink supply tube 172 (FIG. 1) to form a bead of ink 174 in the upper nip between rolls wipe and the operative anilox roll. The wipe roll drive motor 134 is turned on; this turns the wipe roll and, by friction, the wipe roll turns the upper anilox roll at slow speed. The auxiliary electric clutch 126 is turned on. This drives the upper anilox roll in proportion to machine speed, i.e. with the same surface speed between the anilox roll and printing die 26. The wipe roll continues to run at slow speed, creating a wiping action between the wipe roll 42 and the upper anilox roll 36 to squeegee the ink into the cells in the anilox roll surface. The main machine is started, e.g. a flexographic printer, die cutter, creaser and slotter machine for printing and forming container blanks. When the sheet feeder (not shown) of the machine is turned on to feed blanks, the inner side frames 82, 84 are pivoted upwardly to bring the anilox roll 36 into contact with the printing die 26 and printing proceeds When the feeding of blanks ceases, the inner side frames 82, 84 automatically pivot downwardly to bring the anilox roll out of contact with the printing die 26. This prevents excess ink build-up on the printing die. No air pressure is supplied to the air tube 64 of the doctor blade assembly and the spring 66 pulls the channel support 54 away from the anilox roll 36 so that the doctor blades 50, 52 are out of contact with the anilox roll; no ink is supplied to the doctor blade assembly.

To operate the printing station using the doctor blade inking system, the short stroke air cylinder 68 is energized to bring the wipe roll 42 out of contact with the operative anilox roll 36. Air pressure is supplied to the air tube 64 of the doctor blade assembly 40 to force the doctor blades 50, 52 against this upper anilox roll. Ink is pumped into the doctor blade chamber 56 from an ink inlet 176 via passages in the channel support 54. The wipe roll motor 134 is turned on and the auxiliary electric clutch 142 is energized. This turns all three anilox rolls in the same direction at slow speed and ink is squeegeed into the cells of the upper and operative anilox roll by the doctor blades 50, 52 The main machine is started The main electric clutch 126 is energized and the auxiliary clutch 142 is de-energized. The operative anilox roll is thereby driven at machine speed by the gears 130, 124 from the printing cylinder drive gear 132 and through the main electric clutch 126. When the sheet feeder of the main machine starts to feed container blanks 32, the short stroke air cylinder 90 pivots the inner side frames 82, 84 upward to bring the upper anilox roll into contact with the rotating printing die 26 and printing proceeds When the sheet feeder is turned off, the inner side frames 82, 84 are pivoted downwardly to disengage the upper anilox roll, the same as when using the wipe roll.

When it is desired to select and use a different anilox roll, the machine is stopped, no ink is pumped, and all motors and clutches are de-energized. The wipe roll support arms 88 are disconnected from the short stroke air cylinder 68 as previously explained, and the wipe roll 42 moved to the dotted line position shown in FIG. 1. Lock pins 178 (FIG. 1) between the doctor blade support plates 102 and the inner side frames 82, 84 are removed and the doctor blade assembly 40 is pivoted about pivots 60 to the dotted line position shown in FIG. 1. The area is now clear for rotation of the gear cases 74, 76 together with the three anilox rolls, i.e. the complete anilox roll subassembly The locking pins 80 of both gear cases 74, 76 are released and the gear cases are pivoted about the trunnion mounting 78 to place a different anilox roll in the cooperative position for printing, i.e. in the uppermost position. The gear case locking pins 80 are re-inserted in the holes for that selection of anilox roll. The doctor blade assembly and wipe roll are returned to their operating positions. Printing can then be performed as previously described with either inking system.

It will be appreciated from the foregoing that the operator has a choice between using a wipe roll system or a doctor blade system for applying the ink to the printing die, and this choice can be exercised in dependence on the type of printing to be performed. The wipe roll should generally be used for large blocks of solid ink coverage; whereas, doctor blades should generally be used for process printing, that is, with printing dies that lay down the ink on the blank in dots (or half-tone, which is dots of only a single color).

It will also be appreciated that the operator can have a choice of anilox roll surface screens with the foregoing arrangements; choice of screens in this context referring to the size and shape of the ink cells in the anilox roll surface, how many there are in a square inch of roll surface, the ink cell volume—how much ink is held by the cells, etc. Different surface screens provide different printing characteristics. With the preferred embodiment the user can arrange for a choice of three screens at each printing station, that is, the anilox rolls 36, 70, 72 could each be formed with a different screen. Thus, the screen most suited for a particular printing run can be selected for use by moving the particular anilox roll with that screen to the upper operative position. With a machine having two or three printing sections for multicolor printing, the operator can select a different screen for each color where a selected screen is better suited for a particular color.

Printing with the wipe roll system is also influenced by the anilox roll screen. Again, the wipe roll in the present invention can be used with any one of the available screens. The operator can also choose to use a wipe roll in one color section and the doctor blades in another for even greater versatility. And, if desired, each color section in a multi-section printer may have screens different from the other; this makes possible a choice of six screens in a two-color press, nine in a three-color press.

It will further be appreciated from the foregoing that should one anilox roll become damaged or worn out, two remain for use while the one is being repaired or replaced. This reduces the need for keeping expensive, spare anilox rolls available in storage. If the wipe roll needs to be replaced, the operator can still continue printing, by using the doctor blades.

Another advantage of the illustrated embodiment is easy and quick replacement of the anilox and wipe rolls. Traditionally, this has been a time-consuming chore because the wipe roll and anilox roll journals extend through the main frames This has necessitated the removal of gear guards, drive components, motors, and the like and can taken several hours to complete a roll change With the illustrated embodiment, it is only necessary to remove the bearing caps and lift the rolls out, except with the wipe roll the timing belt must also be slid off the end of the pulley although this is an easy task.

The above described embodiments, of course, are not to be construed as limiting the breadth of the present invention. Modifications, and other alternative constructions, will be apparent which are within the spirit and scope of the invention as defined in the appended claims.

For example, in the above preferred embodiment all three anilox rolls turn even though only the top one is inked and applies ink to the printing die. Given the design constraint that the distance between the main frames is fixed, the face width of the anilox rolls may be sacrificed to provide room for electric clutches between the anilox roll end gears and the roll shaft ends so that the rolls may be selectively driven. Likewise, the wipe roll turns whenever the wipe roll motor is turning the anilox roll; again, an electric clutch may be placed in the belt drive system to selectively drive the wipe roll.

Rotation of the gear cases is illustrated as being manual. A spur type ring gear may surround either gear case (being split at the bearing caps to still provide the roll remove feature) and be driven by a motor driven pinion gear for automatic pushbutton rotation of the anilox roll subassembly to a new position. Appropriate locking devices could be used in conjunction with air cylinder operated linkages for automatically unlocking the gear cases, wipe roll support arms, and doctor blade assembly, and moving the latter two to their clear positions, prior to rotating the gear cases.

Other drive systems can be substituted for the belt drive for the wipe roll, e.g. a gear drive.

What is claimed is:

1. A flexographic printing apparatus, comprising:

a main frame;

a printing cylinder rotatably supported by the main frame;

a subassembly comprising a plurality of anilox rolls rotatable about parallel spaced-apart axes, said subassembly being rotatable relative to said main frame about an axis parallel to and between said spaced-apart axes;

means for securing said subassembly in selected positions to enable any selected one of said anilox rolls to be brought into an operative position for cooperating with said printing cylinder for printing;

means for supplying ink to be selected one of said anilox rolls when in said operative position; and said anilox rolls each having a different surface screen providing different printing qualities in dependence upon the particular anilox roll selected.

2. The printing apparatus of claim 1, wherein said subassembly is rotatably mounted in a subframe which is pivotally mounted in said main frame.

3. The printing apparatus of claim 2, wherein said subframe comprises a pair of said frame members pivotally mounted inside said main frame.

4. The printing apparatus of claim 1, wherein each anilox roll includes a gear constantly in mesh with a common central driving gear.

5. The printing apparatus of claim 4, wherein said common driving gear is mounted for rotation on the subassembly rotational axis.

6. The printing apparatus of claim 1, wherein said ink supplying means comprises a doctor blade assembly pivotal to a totally inoperative position away from said printing cylinder and cooperating anilox roll to allow rotation of said subassembly to move a newly selected one of said anilox rolls into said operative position.

7. The printing apparatus of claim 1, wherein said ink supplying means comprises a wipe roll mounted for pivoting to a totally inoperative position away from said subassembly to allow rotation of said subassembly to move a newly selected one of said anilox rolls into said operative position.

8. The printing apparatus of claim 1, wherein said ink supplying means comprises a doctor blade assembly disposed adjacent said subassembly and a wipe roll also disposed adjacent said subassembly.

9. A printing apparatus, comprising:

a main frame;

a printing cylinder rotatably supported by the main frame;

a subassembly comprising a plurality of anilox rolls rotatable about parallel spaced-apart axes, said subassembly being rotatable relative to said main frame about an axis parallel to and between said spaced-apart axes;

means for securing said subassembly in selected positions to enable any selected one of said anilox rolls to be brought into an operative position for cooperating with said printing cylinder for printing;

means for supplying ink to the selected one of said anilox rolls when in said operative position;

said ink supplying means comprising a doctor blade assembly disposed to one side of said subassembly and a wipe roll disposed to the opposite side of said subassembly; and said doctor blade assembly and said wipe roll being pivotal in opposite directions about axes parallel to said subassembly rotatable axis to totally inoperative positions to provide sufficient clearance for rotation of said subassembly for moving a newly selected one of said anilox rolls into said operative position.

10. A printing apparatus, comprising:

a printing cylinder rotatably mounted in a main frame;

a plurality of anilox rolls mounted for rotation about parallel spaced-apart axes in a subassembly;

said subassembly being movable relative to said main frame to bring any one of said anilox rolls into a cooperative position relative to said printing cylinder to enable any one of said anilox rolls to be selected for use in printing with said printing cylinder;

an inking system for inking only the one of said anilox rolls in said cooperative position; and said anilox rolls each having an engraved surface providing ink cells for holding ink, each anilox roll having a differently engraved surface to provide different printing qualities.

11. The printing apparatus of claim 10, wherein said subassembly is rotatably mounted in a pair of inner side frames which are pivotally mounted inside said main frame.

12. The apparatus of claim 10, wherein:

said subassembly has end casing in which shafts of said anilox rolls are rotatably mounted in bearings, said bearings being retained in said casings by removable bearing caps;

said casings are rotatably supported;

a locking arrangement releasably locks said casings in any one of a plurality of selected rotational positions relative to said main frame; and each anilox roll is readily removable in a direction perpendicular to its rotational axis after removing its respective bearing caps in one of said selected rotational positions of said casings.

13. A printing apparatus, comprising:

a printing cylinder rotatably mounted in a main frame;

a plurality of anilox rolls mounted for rotation about parallel spaced-apart axes in a subassembly;

said subassembly being movable relative to said main frame to bring any one of said anilox rolls into a cooperative position relative to said printing cylinder to enable any one of said anilox rolls to be selected for use in printing with said printing cylinder;

an inking system for inking only the one of said anilox rolls in said cooperative position;

said subassembly being rotatably mounted in a pair of inner side frames which are pivotally mounted inside said main frame; and said inking system comprising a wipe roll rotatably mounted between arms pivotally mounted relative to said main frame and said inner side frames.

14. The printing apparatus of claim 13, wherein said inking system further comprises a double doctor blade assembly pivotally mounted between said inner side frames, said wipe roll and said doctor blade assembly being disposed on opposite sides of said cooperative position and being alternatively selectable for supplying ink to the one of said anilox rolls in said cooperative position.

15. A printing apparatus, comprising:

a printing cylinder rotatably mounted in a main frame;

a plurality of anilox rolls mounted for rotation about parallel spaced-apart axes in a subassembly;

said subassembly being movable relative to said main frame to bring any one of said anilox rolls into a cooperative position relative to said printing cylinder to enable any one of said anilox rolls to be selected for use in printing with said printing cylinder;

an inking system for inking only the one of said anilox rolls in said cooperative position;

said subassembly being rotatably mounted in a pair of inner side frames which are pivotally mounted inside said main frame;

an adjustable stop cooperative between said main frame and at least one of said inner side frames to adjust contact pressure between the selected one of said anilox rolls in said cooperative position and said printing cylinder for printing;

a fluid cylinder operative between said main frame and said subassembly for moving said subassembly towards and away from said printing cylinder; and a spring biasing said subassembly towards said printing cylinder.

16. The apparatus of claim 15, wherein said inking system includes an ink pan disposed below said subassembly, said spring is operative between said main frame and at least one of said inner side frames, and said spring is located inside said ink pan.

17. A printing apparatus, comprising:

a printing cylinder rotatably mounted in a main frame;

a plurality of anilox rolls mounted for rotation about parallel spaced-apart axes in a subassembly;

said subassembly being movable relative to said main frame to bring any one of said anilox rolls into a cooperative position relative to said printing cylinder to enable any one of said anilox rolls to be selected for use in printing with said printing cylinder;

an inking system for inking only the one of said anilox rolls in said cooperative position; and said inking system comprising:

a wipe roll adjacent said cooperative position;

a doctor blade assembly adjacent said cooperative position;

means for moving said wipe roll into and out of contact with the selected anilox roll in said cooperative position;

means for moving said doctor blade assembly into and out of contact with the selected anilox roll in said cooperative position; and additional means for enabling movement of the wipe roll and the doctor blade assembly to totally inoperative positions remote from said cooperative position to accommodate movement of said subassembly to bring any selected anilox roll into said cooperative position.

18. The apparatus of claim 17, wherein said wipe roll is rotatably mounted in bearings housed in free ends of pivotal arms, removable bearing caps retain said bearings in said free ends, and removal of said end caps in said totally inoperative position of said wipe roll enables said wipe roll to be lifted from said free ends and removed.

19. A printing apparatus, comprising;

a main frame;

a printing cylinder rotatably supported by said main frame;

a subframe pivotally mounted on said main frame;

a plurality of spaced apart, parallel ink rolls rotatably mounted in and between two casings;

said casings being rotatably mounted in said subframe for selectively bringing any selected one of said ink rolls into an operative position for use in cooperation with said printing cylinder for printing;

a locking device releasably locking said casings relative to said subframe to retain the selected ink roll in said operative position;

means for pivoting said subframe relative to said main frame to press said selected ink roll against said printing cylinder when printing but to space said selected ink roll from said printing cylinder when not printing;

alternative inking systems comprising a wipe roll located to one side of the selected ink roll in said operative position and a doctor blade assembly located to an opposite side thereof;

said wipe roll being mounted for pivotal movement relative to said subframe towards and away from said operative position;

an adjustable stop on said subframe for determining the limit of pivotal movement of said wipe roll towards said operative position; and said doctor blade assembly being mounted on said subframe and being adjustably movable relative to said subframe against and away from the selected ink roll in said operative position.

20. The printing apparatus of claim 19, wherein at least one of said casings contains a central gear in mesh with a separate gear on the end of each ink roll.

21. The printing apparatus of claim 19, wherein both of said casings are gear casings, each ink roll has a gear at each end, each gear casing contains a central gear meshing with the gears on the adjacent ends of the ink rolls, and said central gears are mounted on concentric shafts about which said casings are rotatable.

22. The printing apparatus of claim 19, wherein said ink rolls are anilox rolls with different surface screens.

23. The printing apparatus of claim 19, wherein:

an adjustable stop, operative between said man frame and said subframe, limits movement of said selected ink roll towards said printing cylinder by said subframe pivoting means to adjust the pressing of the selected ink roll against said printing cylinder when printing;

said wipe roll and said subframe are pivoted about a common axis; and resilient means, operative between said main frame and said subframe, for urging said subframe to pivot towards said printing cylinder to at least partly counter-balance the weight of the plurality of anilox rolls and reduce the load placed upon said subframe pivoting means.

24. The printing apparatus of claim 19, wherein said ink rolls are mounted in bearings supported in said casings, said bearings are retained in said casings by removable bearing caps, and each ink roll when in a different position from said operative position being removable in a direction perpendicular to its rotational axis by removal of the bearing caps retaining its bearings.

25. A flexographic printing apparatus, comprising:

a main frame;

a printing cylinder rotatably supported by the main frame;

a subassembly comprising a plurality of anilox rolls rotatable about parallel spaced-apart axes, said subassembly being rotatable relative to said main frame about an axis parallel to and between said spaced-apart axes;

said anilox rolls having different surface screens;

means for securing said subassembly in selected positions to enable any selected one of said anilox rolls to be brought into an operative position for cooperating with said printing cylinder for printing;

means for supplying ink to the selected one of said anilox rolls when in said operative position;

said ink supplying means comprising a doctor blade assembly and a wipe roll independently movable into engagement with the selected one of said anilox rolls when in said operative position; and said doctor blade assembly and said wipe roll being pivotal about axes parallel to said subassembly rotatable axis to totally inoperative positions to provide sufficient clearance for rotation of said subassembly for moving a newly selected one of said anilox rolls into said operative position.

26. A printing apparatus, comprising:

a printing cylinder rotatably mounted in a frame;

a plurality of anilox rolls mounted for rotation about parallel spaced-apart axes in a subassembly;

said subassembly being movable relative to said frame to bring any one of said anilox rolls into an operative position relative to said printing cylinder to enable any one of said anilox rolls to be selected for use in printing with said printing cylinder;

an inking system having a wipe roll and a doctor blade assembly separately operable with the selected one of said anilox rolls when in said operative position; and said anilox rolls having different surface screens enabling each anilox roll, when in said operative position, to present a different surface screen to said printing cylinder.

27. A method of inking a printing cylinder of a flexographic printing apparatus for printing, comprising the steps of:

selecting an anilox roll from a subassembly having two or more anilox rolls with each anilox roll having a surface screen different from the others;

moving the selected anilox roll from an inoperative position to an operative position for cooperating with said printing cylinder;

selecting one of a wipe roll and a doctor blade assembly for use in connection with the selected anilox roll;

moving the selected one of said wipe roll and said doctor blade assembly from an inactive position to an active position for metering ink on said selected anilox roll; and rotating said printing cylinder and said selected anilox roll in cooperative engagement while metering ink on said selected anilox roll by the selected one of said wipe roll and said doctor blade assembly.

28. The method of claim 27, wherein printing quality of said printing apparatus is changed by performing the further steps of:

moving the selected one of said wipe roll and said doctor blade from said inactive position to said inactive position;

moving said selected anilox roll to said inoperative position and selecting another anilox roll from said subassembly by rotating said subassembly;

moving said another anilox roll to the operative position for cooperating with said printing cylinder;

selecting either of said wipe roll and said doctor blade assembly, and moving such to its active position for metering ink on said another anilox roll; and rotating said another anilox roll in cooperative engagement with said printing cylinder while metering ink on said another anilox roll.

* * * * *

UNITED STATES PATENT AND TRADEMARK OFFICE

CERTIFICATE OF CORRECTION

PATENT NO. : 5,081,928

DATED : January 21, 1992

INVENTOR(S) : HARRISON

It is certified that error appears in the above-identified patent and that said Letters Patent is hereby corrected as shown below:

In Claim 1, column 9, line 55, "be" should be --the--;

In Claim 12, column 11, line 1, "casing" should be --casings--;

In Claim 23, column 13, line 17, "man" should be --main--; and

Signed and Sealed this

Eighteenth Day of May, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,081,928

DATED : January 21, 1992

INVENTOR(S) : John R. Harrison

It is certified that error appears in the above-identified patent and that said Letters Patent is hereby corrected as shown below:

In Claim 1, column 9, line 55, "be" should be --the--;

In Claim 12, column 11, line 1, "casing" should be --casings--;

In Claim 23, column 13, line 17, "man" should be --main--; and

In Claim 28, column 14, line 46, "inactive" should read --active--.

This certificate supersedes Certificate of Correction issued May 18, 1993.

Signed and Sealed this

Fifteenth Day of June, 1993

Michael K. Kirk

MICHAEL K. KIRK

*Acting Commissioner of Patents and Trademarks*

*Attest:*

*Attesting Officer*